United States Patent [19]

Down et al.

[11] 4,356,029

[45] Oct. 26, 1982

[54] TITANIUM PRODUCT COLLECTION IN A PLASMA REACTOR

[75] Inventors: Michael G. Down, Plum Boro; Joachim V. R. Heberlein, Forest Hills; Thomas N. Meyer, Murrysville, all of Pa.

[73] Assignee: Westinghouse Electric Corp., Pittsburgh, Pa.

[21] Appl. No.: 333,838

[22] Filed: Dec. 23, 1981

[51] Int. Cl.[3] ..... B22F 9/20; B22F 9/22

[52] U.S. Cl. ..... 75/0.5 B; 75/0.5 BA; 75/0.5 BB

[58] Field of Search ..... 75/0.5 B, 0.5 BA, 0.5 BB, 75/0.5 BC, 10 R

[56] References Cited

U.S. PATENT DOCUMENTS

| | | | |
|---|---|---|---|
| 3,211,548 | 10/1965 | Scheller et al. | 75/0.5 BB |
| 3,630,718 | 12/1971 | Nevenschwander | 75/0.5 BB |
| 3,738,824 | 6/1973 | Davis et al. | 75/0.5 BB |
| 3,748,106 | 7/1973 | Davis et al. | 75/0.5 BB |

*Primary Examiner*—W. Stallard
*Attorney, Agent, or Firm*—M. J. Moran

[57] ABSTRACT

A method for producing a metal by reduction of a metal halide characterized by the steps of feeding into a plasma such as the arc heated stream of an arc heater, a quantity of a reducing metal such as an alkali or alkaline earth metal, feeding into the plasma a quantity of a metal halide, maintaining the temperature of the reaction chamber wall higher than the vapor point of the alkali metal chloride formed or alkaline earth metal chloride formed but lower than the melting point of the elemental metal, co-products formed being an elemental metal and a gaseous salt, projecting the co-products into the reaction chamber to cause the metal to deposit on the interior wall of the collection chamber, removing the gaseous salt, heating the metal deposited on the interior of the reaction chamber with the arc heated stream thereby causing the elemental metal to fall gravitationally or be blown into an associated receptacle in the form of solidified globules and/or crystals and/or granules and/or large diameter powders.

10 Claims, 4 Drawing Figures

TITANIUM PRODUCT COLLECTION IN A PLASMA REACTOR

GOVERNMENT CONTRACT

The Government has rights in this invention pursuant to Contract No. F33615-80-C-5091 awarded by the United States Air Force Materials Laboratory.

BACKGROUND OF THE INVENTION

This invention relates, generally, to the production of titanium and in particular to plasma production of titanium powder.

The properties of high corrosion resistance and strength, combined with a relatively low density, result in titanium alloys being ideally suited to many applications such as in the aerospace industry. However, the widespread use of titanium has been and continues to be severely limited by its high cost which is a direct consequence of the high energy consumption and batch nature of conventional titanium metal production and of the amount of waste in producing finished titanium parts. Two of the processes most commonly used to produce titanium are the Kroll and Hunter processes.

These processes are performed on a large scale basis, which have been relatively unchanged for many years and essentially follow five steps:

1. chlorination of impure oxide ore;
2. purification of $TiCl_4$;
3. reduction by sodium (Na) or magnesium (Mg) to produce titanium (Ti) sponge;
4. removal of the sponge; and
5. leaching, distillation and vacuum remelting to remove chloride (Cl), sodium or magnesium impurities.

The combined effects of the inherent cost of this process, difficulty associated with forging and machining titanium and, more recently, a shortfall in sponge availability contribute to a relatively small utilization of titanium.

Recently, various new methods have come about. Two examples being the use of an arc heater to produce titanium as well as a reduction process utilizing an arc heater with the end product being titanium ingots. These methods are found in U.S. Pat. No. 4,107,445 "Titanium and Zirconium Production by Arc Heater" issued Aug. 15, 1978 to Wolf et al. and U.S. Pat. No. 4,080,194 "Titanium or Zirconium Reduction Process by Arc Heater" issued Mar. 21, 1978 to Fey, respectively. Utilized by the above-mentioned patents, liquid titanium was to be formed and continuously removed from a chamber in the form of ingots. However, due to the high degree of reactivity between liquid titanium and most common high temperature structural materials, undesirable impurities could be formed in the final product.

It is also desirable to have a device which will produce titanium powders which are more readily usable for certain applications. Additionally, it is advantageous to have titanium produced which is free of sodium chloride co-product and contains no residual chlorine. Additionally, it is desirable to produce titanium which is relatively inexpensive to produce when compared with previous methods, requiring fewer steps than previous methods as well as being in a readily usable form for subsequent processing.

Accordingly, the present invention relates to a process for producing a metal by reduction of a chloride salt comprising the steps of providing an arc heater striking an arc in the axial gap between the electrodes of the arc heater, introducing a pressurized gas or gas mixture consisting of argon or helium and hydrogen inwardly through the gap and into the arc chamber to blow the electric arc from the gap into the interior of the elongated arc chamber thereby forming an elongated arc jet stream comprising the gas and projecting from the arc chamber into the reaction chamber, feeding a quantity of an alkali metal or an alkaline earth metal in the plasma stream, maintaining a temperature of the reaction chamber walls higher than the vapor point of the alkali metal chloride or alkaline earth metal chloride and lower than the melting point of the elemental metal, projecting the reaction products into the collection chamber to cause the elemental metal to separate from the gaseous salt and deposit on the interior wall of the reaction chamber as a solid; and feeding the arc jet stream past the elemental metal deposited on the interior wall of the reaction chamber thereby permitting the deposited elemental metal to become molten and subsequent to being blown by the arc jet stream, rapidly cooled in lower parts of the reaction chamber to a temperature above the boiling point of the alkali metal chloride or the alkaline earth metal chloride but below the melting point of the metal thereby permitting the metal to solidify and fall gravitationally into an associated receptacle in the form of solidified globules, crystals, granules and large diameter powders.

BRIEF DESCRIPTION OF THE DRAWINGS

Reference is now made to the description of the preferred embodiment illustrated in the accompanying drawings, in which.

DESCRIPTION OF THE PREFERRED EMBODIMENT

Figure 1:
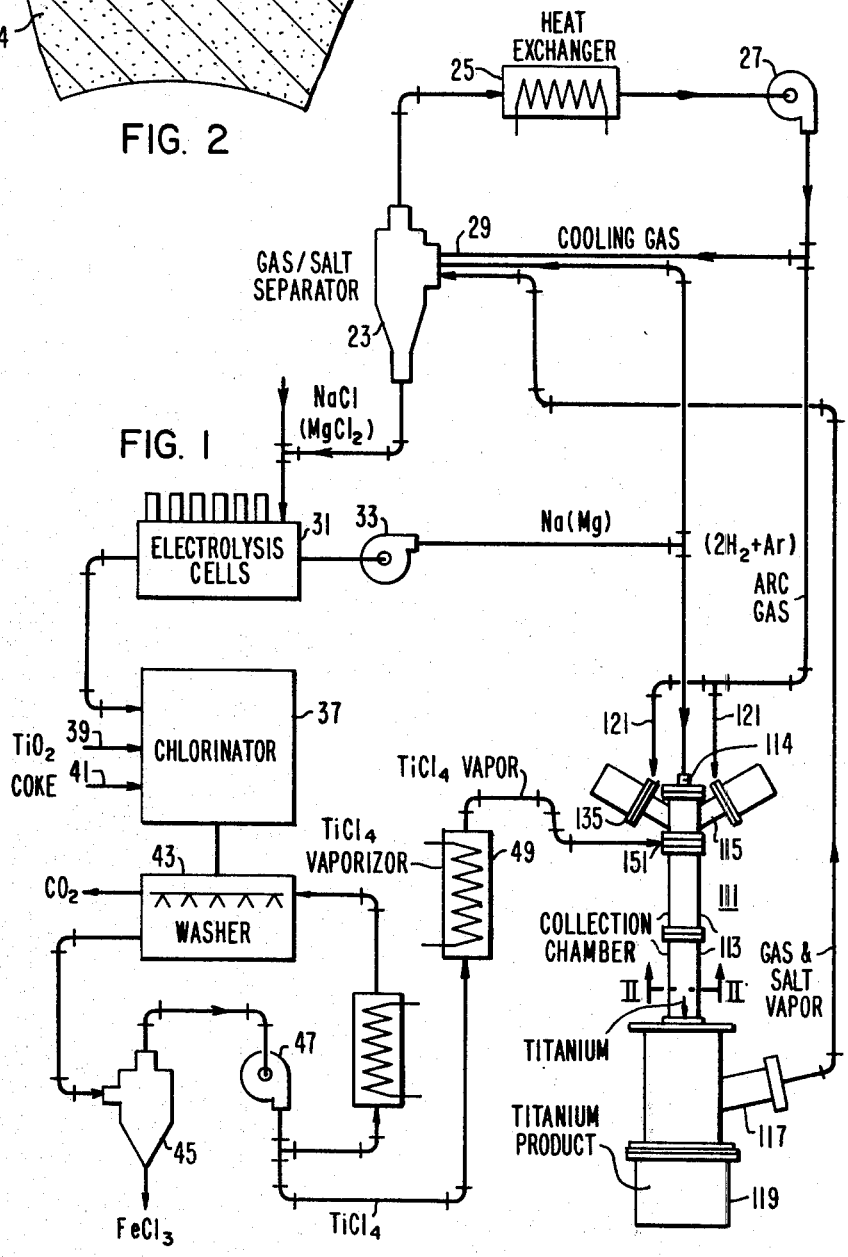
FIG. 1 is a flow diagram.

The process of the present invention may be carried out in a reactor generally indicated at 111 in FIG. 1. A portion of the process and of the associated apparatus is described more fully in U.S. Pat. No. 4,080,194 "Titanium or Zirconium Reduction Process by Arc Heater" issued Mar. 21, 1978 to Fey, and is incorporated by reference herein. Therefore only a brief description of the applicable components may be found below. The reactor 111 is supported by associated structures as shown in FIG. 1. The reactor 111 comprises a collection tube 113, at least one and preferably a plurality of arc heaters 115, a first vent or outlet means 117 for co-product gases and second vent or outlet means 119 for collection of the primary product, namely, titanium.

Gas is introduced into the system arc heater 115 at 121 and subsequently into the reaction chamber 111. The gas, together with the gaseous co-products including salt vapor leave the reactor through the outlet means 117 and are connected to a cyclone-type separator 23 for separating the gas and salt, the former of which is transmitted to a heat exchanger 25 for cooling and redirected by a pump 27 into the arc heaters at inlet 121. Cooling gas is also introduced at inlet 29 of the separator to cool the gas-salt mixture sufficient to condense the salt to the liquid state. The liquid salt leaves the lower end of the separator 23 from where it is conducted to electrolysis cel 31 for dissociating the salts into their primary elements such as sodium or magnesium and chlorine.

The metal sodium or magnesium is transmitted by a pump 33 to an inlet plenum having an inlet 114 where it is introduced into the reactor. The resulting chlorine from the cell 31 is conducted to a chlorinator 37 where, together with a metal oxide, such as titanium dioxide, introduced at inlet 39 and a carbonaceous material, such as coke, introduced at inlet 41 react with the chlorine to produce a metal chloride, such as titanium tetrachloride ($TiCl_4$), and carbon dioxide which are directed to washer 43 for separation. The metal chloride proceeds through a cyclone separator 45 for removal of any foreign materials such as iron trichloride ($FeCl_3$), from where the tetrachloride is moved by pump 47 to a vaporizer 49 and then to the reactor 111 at an inlet 151.

The end product is the elemental metal titanium, which is in the form of a solid product such as solidified globules, crystals, granules and large diameter powders and thereafter drops through outlet means 119. Thereafter, the product is in a form suitable for sieving into the various mesh sizes required for differing applications.

Feed stock material is introduced through inlet ports 114 and 151. The sodium, or alternately magnesium, in the liquid state, is introduced upstream of the arc heaters 115 and is entered into an arc heated gas stream (not shown). The titanium tetrachloride ($TiCl_4$) is then introduced downstream of the arc heated gas stream whereby the reaction takes place. The materials introduced through the inlet ports 114 and 151 react substantially as shown in the following formulae:

$$TiCl_4 + 4Na \rightarrow Ti + 4NaCl \uparrow \quad (1)$$

$$TiCl_4 + 2Mg \rightarrow Ti + 2MgCl_2 \uparrow \quad (2)$$

The foregoing formulae are exemplary of the possibilities available for producing the titanium product. It is to be understood that the titanium may be introduced as either a chloride or other halide which in turn is reacted with either sodium or magnesium or other alkali or alkali earth-metal to produce the products indicated.

Figure 2:
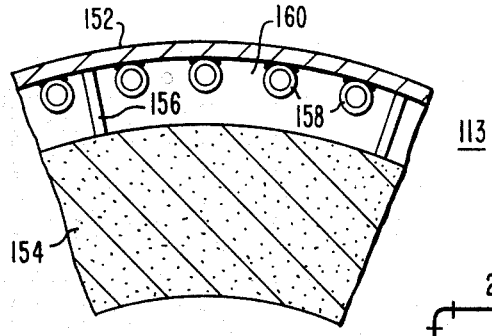
FIG. 2 is a cross-sectional view taken on the line II—II of FIG. 1.

As shown in FIGS. 1 and 2, the collection tube 113 is preferably cylindrical so as to enhance the separation of the co-products of the reactions having lower vaporization temperatures from those with higher ones, whereby the gaseous salt products leave the reactor 111 via the outlet means 117 and the heavier metal exits through the outlet means 119.

The collection chamber 113 joins the reaction chamber plenum and the lower portion of the reactor 111 containing the outlet means 117 and the outlet means 119. Moreover, in accordance with the invention and as shown by FIG. 2, the collection chamber 113 comprises an outer wall 152 which is substantially concentrically disposed having contained therein coolant lines 158 which in the preferred embodiment of the present invention are used to circulate water along the outer wall 152 thereby facilitating heat transfer from the interior of the collection tube 154 to the exterior or outer wall 152 which is critical to the operation of the reactor 111. The collection tube 154 is supported by collection tube supports 156 which are attached to the collection tube 154 and to the interior portion of the outer wall 152. Disposed between the interior portion of the outer wall 152 and the collection tube 154 is an insulation gap 160 which is also used to control heat transfer critical to the operation of the reactor 111.

Inasmuch as the heat transfer from the collection tube 154 to the coolant lines 158 and thence to the outer wall 152 is critical to the operation of the reactor 111, certain product materials or metals having different thermal properties or coefficient of heat transfer which require additional control means for preventing heat escape from the chamber too rapidly may be utilized. Accordingly, the insulation gap 160 may have either air or any suitable gas or solid material suitable for the necessary heat transfer characteristics of the present invention, and in the preferred embodiment of the present invention is air. Additionally, the collection tube 154 is graphite in the preferred embodiment of the present invention with the collection tube supports 156 being made of the same material. However, it is to be understood that a ceramic material, such as magnesium oxide (MgO) or silicon carbide in a thickness sufficient to delay ultimate transfer of heat to the water cooled peripheral walls may be utilized with the collection tube supports 156 being also of graphite or of any suitable material having the necessary structural and heat transfer characteristics. Accordingly, during reactor 111 operation, the temperature of the wall of the collection tube 154 is always maintained higher than the vapor point of sodium chloride NaCl (1385° C.) but lower than the melting point of titanium (1675° C.), that is, within a 290° C. temperature window. It is within this temperature range that when the reactants, typically titanium tetrachloride ($TiCl_4$) and sodium (Na) are injected downwards reacting with the plasma stream (typically an argon/hydrogen mixture of molar ratio $Ar:H_2 = 1.4$) that titanium product will deposit on the wall in the form of loosely-adhering dendrites.

Figure 3:
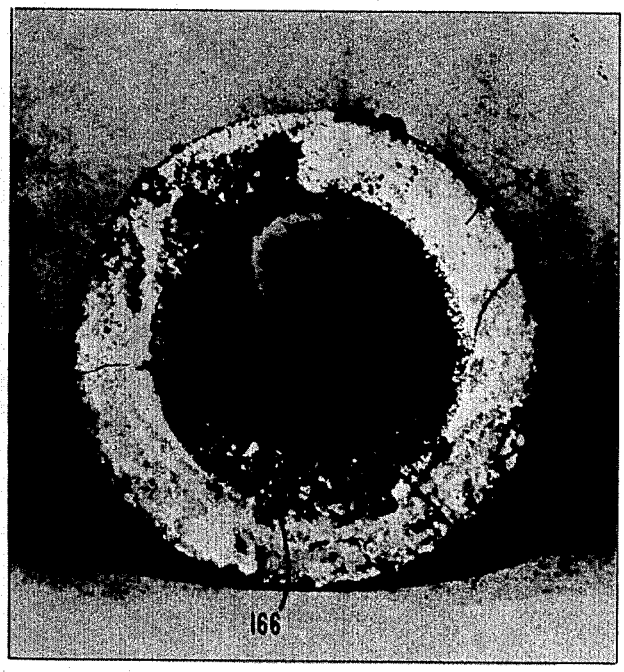
FIG. 3 is a picture of the collection tube of FIG. 2.

Referring to FIG. 3, there can be seen a cross-sectional view taken through the collection chamber 113 of FIGS. 1 and 2. Here, the collection tube 154 has dendrites 166 which loosely adhere to the inner wall of the collection tube 154. During the operation of the reactor 111, the tips of the dendrites 166 in that they penetrate the collection tube 154 wall boundary layer are exposed to the temperature from the hot plasma stream will reach a temperature above the melting point of titanium. These dendrite tips may be blown off by the hot plasma stream, are subsequently quenched in the lower, cooler (1385°–1675° C.) parts of the collection chamber 113 or they may simply fall due to gravitation. In this way, the solid product collected in the base of the crucible or outlet means 119 will be comprised of solidified globules, crystals, granules and large diameter powders. Thus, a titanium product is formed which is suitable for sieving into various mesh sizes.

The following example is exemplary of the process of this invention.

EXAMPLE

Figure 4:
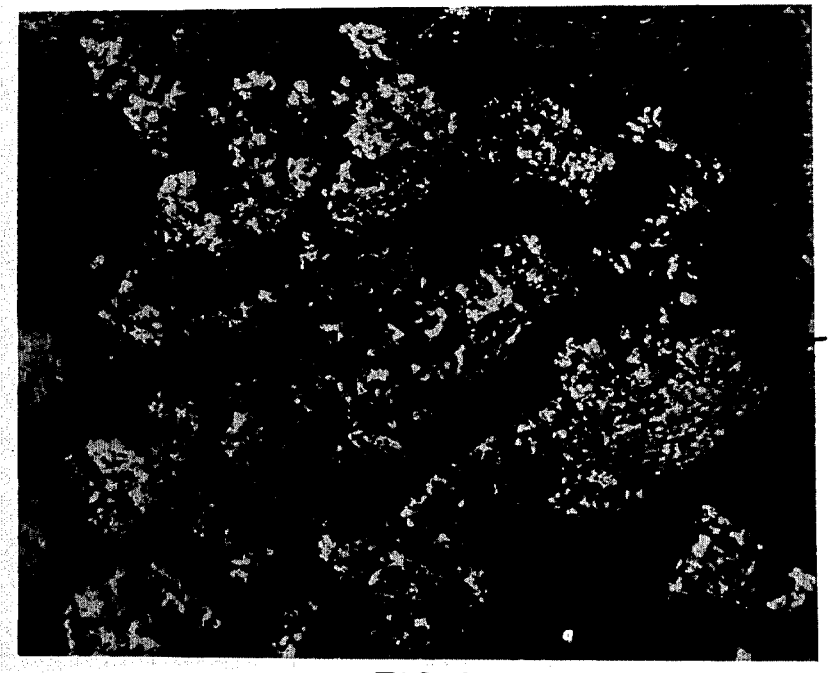
FIG. 4 is a picture of the titanium powder product removed from the collection tube shown in FIG. 3.

As shown in FIG. 1, titania and coke are reacted with chlorine to produce $TiCl_4$, $CO_2$ and traces of iron chloride ($FeCl_3$), which are separated by filtering. The titanium tetrachloride ($TiCl_4$) is condensed in washer 43 and gaseous $CO_2$ is then removed. After being vaporized, the purified titanium chloride (gas) is injected into the reactor 111 at 151. A liquid alkali metal (sodium or magnesium) is atomized and simultaneously injected into the collection chamber 113. As titanium is formed, the titanium product deposits on the inside wall of the collection tube 154 in the form of loosely-adhering dendrites. The length of the dendrites will grow until the tips are at a temperature above the melting point of titanium. The dendrite tips, once heated by the hot plasma stream, become molten and begin to fall to the lower parts of the collection chamber 113 subsequently being quenched in the lower, cooler parts of the collection chamber 113. Referring now to FIG. 4 the titanium product 168 produced by the present invention can be seen. Vaporized alkali salt exits through the outlet means 117 along with the hydrogen-argon stream. After leaving the reactor 111, the metal chloride vapor and heat transfer gas hydrogen-argon are cooled below the chloride dew point by admixture of cold hydrogen-argon. The salt is then collected and dissociated electrolytically in existing technology cells and the alkaline metal and chlorine are circulated to the respective loops in the process. The hydrogen-argon mixture is cleaned, cooled, compressed, and recirculated to the arc heaters.

It is to be understood that different embodiments of the present invention may be utilized without departing from the spirit and scope of the present invention. For example, the collection chamber may be of a different shape or configuration. Additionally the coolant lines may carry coolant other than water such as, for example, liquid sodium-potassium alloy or other suitable coolant material. Further, the collection tube may be of any suitable material which will have the necessary thermal characteristics allowing titanium dendrites to form on the inner wall thereof and non-reacting with the titanium itself. Similarly, the collection tube supports may be of any suitable material as mentioned previously and the insulation gap between the collection tube and the outer wall may be filled with an insulation material or a gas other than air. Additionally, the method of injecting the titanium tetrachloride ($TiCl_4$) may be accomplished through either axial or through radially displaced injection nozzles. Similarly, the sodium (Na) or magnesium (Mg) which may be utilized may be injected at the same point as the titanium tetrachloride using the same or similar manner as the titanium tetrachloride injection.

Thus, the disclosed invention provides a relatively inexpensive process for producing titanium product which is free of sodium chloride co-product and having no residual chlorine. Additionally, the present invention provides a titanium product which is in a readily usable form for subsequent industry application which substantially cuts down on waste when compared with previous processes. Therefore, the present invention provides an easier and more efficient method of producing titanium product in a continuous and repeatable manner.

What we claim is:

1. A process for reducing a metal from a chloride salt; comprising the steps of:

(a) striking an electric arc in an axial gap between the electrode of an arc heater;

(b) introducing a pressurized gas or gas mixture consisting of argon, helium and hydrogen through the gap and into the arc chamber to blow the electric arc from the gap and into the interior of the elongated arc chamber to form an elongated arc jet stream comprising the gas and projecting from the arc chamber into a reaction chamber;

(c) feeding into the arc jet stream a quantity of one element selected from the group consisting of an alkaline metal and an alkaline earth metal;

(d) feeding into the arc jet stream a quantity of a chloride of a metal;

(e) maintaining a temperature of the reaction chamber walls higher than the vapor point of the alkali metal chloride or alkaline earth metal chloride and lower than the melting point of the elemental metal;

(f) projecting the reaction products into a collection chamber to cause the elemental metal to separate from the gaseous salt and deposit on the interior wall of the collection chamber as a solid; and (g) feeding the arc jet stream past the elemental metal deposited on the interior wall of the collection chamber thereby permitting the deposited elemental metal to become molten and subsequent to being blown by the arc jet stream, rapidly cooled in lower parts of the collection chamber, which are cooler than the uppermost parts thereby permitting the metal to be blown or fall gravitationally into an associated receptacle in the form of solidified globules, crystals, granules and large diameter powders.

2. The process of claim 1 in which said one element is sodium.

3. The process of claim 1 in which said one element is magnesium.

4. The process of claim 1 in which titanium tetrachloride is fed in step (d) and titanium is a co-product.

5. The process of claim 1 in which the temperature of the collection chamber wall is maintained between 1385° C. and 1675° C.

6. The process of claim 5 in which magnesium and titanium tetrachloride are fed in steps (c) and (d).

7. The process of claim 6 in which sodium and titanium tetrachloride are fed in steps (c) and (d).

8. The process of claim 1 in which the pressurized gas of step (b) is injected radially.

9. The process of claim 1 in which the pressurized gas of step (b) is injected tangentially.

10. A process for reducing a metal from a chloride salt comprising the steps of:

(a) introducing a heated plasma stream into the interior of a reaction chamber;

(b) feeding into the plasma stream a quantity of one element selected from the group consisting of an alkaline metal and an alkaline earth metal;

(c) feeding into the plasma stream a quantity of a chloride of a metal;

(d) maintaining a temperature of the reaction chamber walls higher than the vapor point of the alkali metal chloride or alkaline earth metal chloride and lower than the melting point of the elemental metal;

(e) projecting the reaction products into a collection chamber to cause the elemental metal to separate from the gaseous salt and deposit on the interior wall of the collection chamber as a solid; and (f) feeding the plasma stream past the elemental metal deposited on the interior wall of the collection chamber thereby permitting the deposited elemental metal to become molten and subsequent to being blown by the plasma stream, rapidly cooled in lower parts of the collection chamber, which are cooler than the uppermost parts thereby permitting the metal to be blown or fall gravitationally into an associated receptacle in the form of solidified globules, crystals, granules and large diameter powders.

* * * * *